US007841701B2

(12) United States Patent
Kim

(10) Patent No.: US 7,841,701 B2
(45) Date of Patent: Nov. 30, 2010

(54) INKJET PRINTER

(75) Inventor: Min Cheol Kim, Kyoungki-do (KR)

(73) Assignee: Hydis Technologies Co., Ltd., Gyeonggi-do (KR)

( * ) Notice: Subject to any disclaimer, the term of this patent is extended or adjusted under 35 U.S.C. 154(b) by 958 days.

(21) Appl. No.: 11/707,436

(22) Filed: Feb. 16, 2007

(65) Prior Publication Data

US 2007/0200899 A1 Aug. 30, 2007

(30) Foreign Application Priority Data

Feb. 24, 2006 (KR) ..... 10-2006-0018170

(51) Int. Cl.
*B41J 2/06* (2006.01)

(52) U.S. Cl. ..... 347/55

(58) Field of Classification Search ..... 347/53, 347/73–74, 76, 77

See application file for complete search history.

(56) References Cited

U.S. PATENT DOCUMENTS

2002/0118258 A1* 8/2002 Bajeux ..... 347/77

* cited by examiner

*Primary Examiner*—Matthew Luu
*Assistant Examiner*—Lisa M Solomon
(74) *Attorney, Agent, or Firm*—Joseph P. Krause; Kelly & Krause, LP

(57) ABSTRACT

Disclosed is an inkjet printer including an inkjet head containing electrically conductive ink and having a nozzle for spraying the ink and a mask positioned on a side of the inkjet head, the mask having a number of slits formed so that the electrically conductive ink passes through the slits and an electromagnetic field is established. The electromagnetic field is used to control the direction of movement of sprayed ink for uniform ink spraying.

2 Claims, 3 Drawing Sheets

INKJET PRINTER

BACKGROUND OF THE INVENTION

1. Field of the Invention

The present invention relates to an inkjet printer, and more particularly to an inkjet printer capable of spraying ink onto an LCD with improved accuracy.

2. Description of the Prior Art

As generally known in the art, an LCD is an electronic device adapted to convert various types of electric information, which is created by different devices, into visual information by using the change of transmittance of liquid crystals, which depends on the applied voltage, and display corresponding images. LCDs are used as the information display window of portable terminals and laptop computers, for example.

The LCD includes an upper substrate, a lower substrate positioned so as to face the upper substrate with a spacing between them, and a liquid crystal layer interposed between the upper and lower substrates so as to act as a shutter.

The upper substrate has color filter layers for implementing desired colors on a screen. The color filter layers are defined by R, G, B ink, which is sprayed onto the upper substrate by an inkjet printer.

However, conventional inkjet printers have a problem in that they may erroneously spray ink 13 onto undesired pixels, as shown in FIG. 1, and create blurred or low-quality images resulting from the mixing of colors.

In an attempt to solve this problem, it has been proposed to increase the surface energy of ink itself, form a wet layer on desired pixels, and spray ink onto the desired pixels by using a mask. Alternatively, the surface of pixels is subjected to fluorine plasma, in order to modify the properties. However, these proposed methods have failed to solve the problem of inaccurate ink spraying.

In the drawing, reference numeral 10 refers to an inkjet printer, 11 is an inkjet head, 12 is a nozzle, 20 is an upper substrate, and 21 is a black matrix.

SUMMARY OF THE INVENTION

Accordingly, the present invention has been made to solve the above-mentioned problems occurring in the prior art, and an object of the present invention is to provide an inkjet printer capable of spraying ink with improved accuracy.

In order to accomplish this object, there is provided an inkjet printer including an inkjet head containing electrically conductive ink and having a nozzle for spraying the ink and a mask positioned on a side of the inkjet head, the mask having a number of slits formed so that the electrically conductive ink passes through the slits and an electromagnetic field is established.

The mask preferably has a number of electric wires positioned on a highly-elastic thin metallic layer so that opposite polarities alternate with each other while being adjacent to each other and magnets laminated on the electric wires with an insulation layer interposed between each layer.

Preferably, the magnets establish a magnetic field in a predetermined direction and a current flows through the electric wires in a predetermined direction so that electromagnetic force is created by the magnetic field and the current towards a center of the slits.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
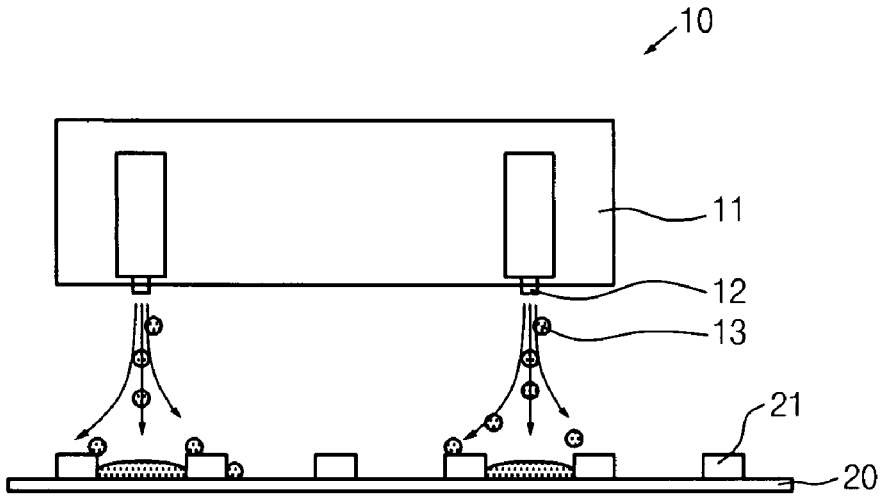
FIG. 1 (PRIOR ART)
FIG. 1 shows a conventional inkjet printer in the process of spraying ink.

Hereinafter, a preferred embodiment of the present invention will be described with reference to the accompanying drawings. In the following description and drawings, the same reference numerals are used to designate the same or similar components, and so repetition of the description on the same or similar components will be omitted.

Figure 2:
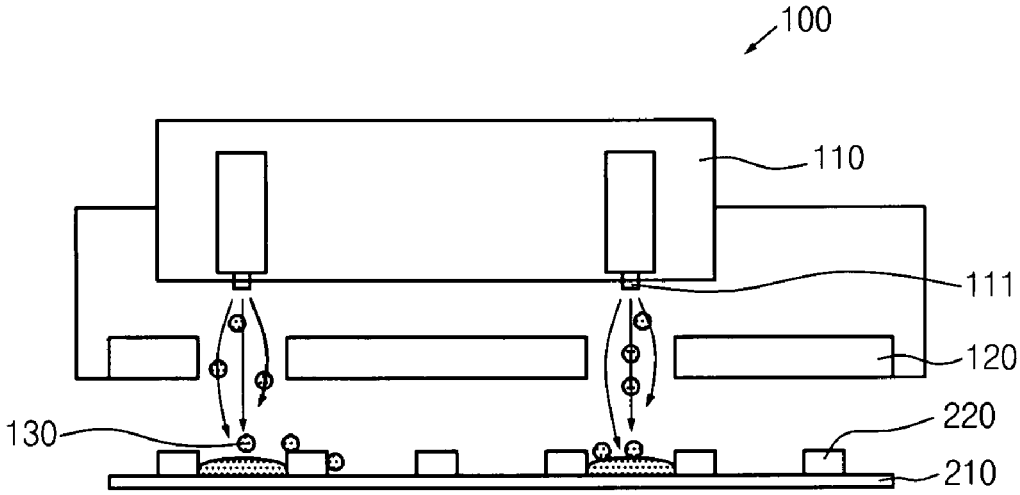
FIG. 2 shows an inkjet printer in the process of spraying ink according to an embodiment of the present invention.

FIG. 2 briefly shows an inkjet printer according to an embodiment of the present invention.

Referring to the drawing, the inkjet printer 100 includes an inkjet head 110 and a mask 120 positioned on one side of the inkjet head 110.

The inkjet head 110 contains electrically conductive ink 130, which is sprayed via a nozzle 111 positioned on one side of the inkjet head 110.

Figure 3:
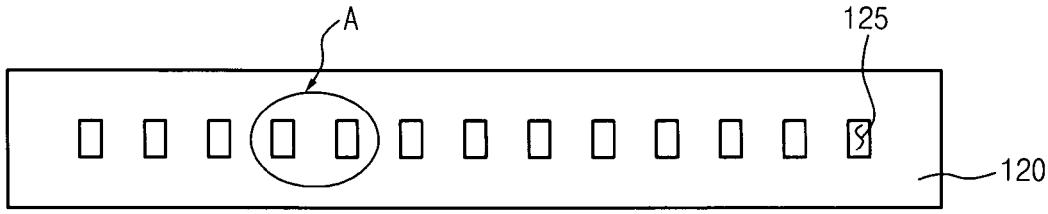
FIG. 3 is a top view of a mask shown in FIG. 2.

The mask 120 has a number of slits 125 formed thereon so that the electrically conductive ink 130, which is sprayed via the nozzle 111, passes thorough the slits 125, as shown in FIG. 3.

Figure 4:
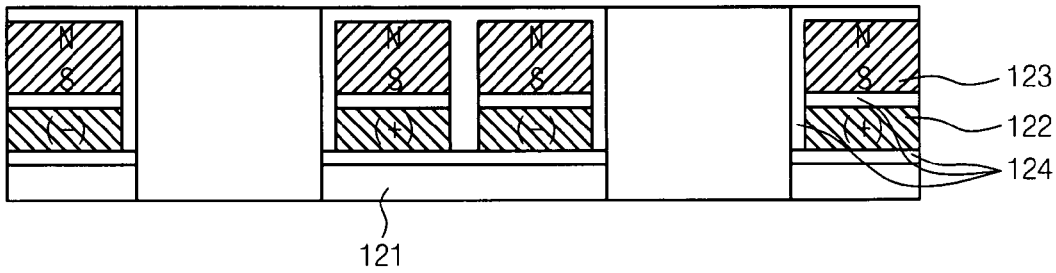
FIG. 4 is a sectional view showing part A of FIG. 3.

In order to establish an electromagnetic field, the mask 120 has a number of electric wires 122 and magnets 123 laminated on a highly-elastic thin metallic layer 121 with an insulation layer 124 interposed between each layer, as shown in FIG. 4.

The high elasticity of the thin metallic layer 121 enables it to easily return to the original shape after deformation (e.g. bending) during a process for manufacturing the mask 120 and facilitates pattern formation.

Every two of the electric wires 122, which are adjacent to each other, have different polarities.

Particularly, the polarity of an end of each electric wire 122 is opposite to that of an end of an adjacent electric wire 122.

The magnets 123 have S and N poles defined on their lower and upper portions, respectively, so that lines of magnetic force are directed from top to bottom.

The mask 120, which has the electric wires 122 and the magnets 123, causes the electrically conductive ink 130, which is sprayed from the nozzle 111, to pass through the slits of the mask 120 along a path in the same direction under the influence of electromagnetic force F, which is created according to the law of electromagnetic force (i.e. Fleming's law) which states that, when a magnetic field B is perpendicular to a current I in the same plane, electromagnetic force F is created by the magnetic field B and the current I in a direction perpendicular to that plane.

In short, the mask 120 controls the direction of movement of the electrically conductive ink 130 from the nozzle 111.

Figure 5:
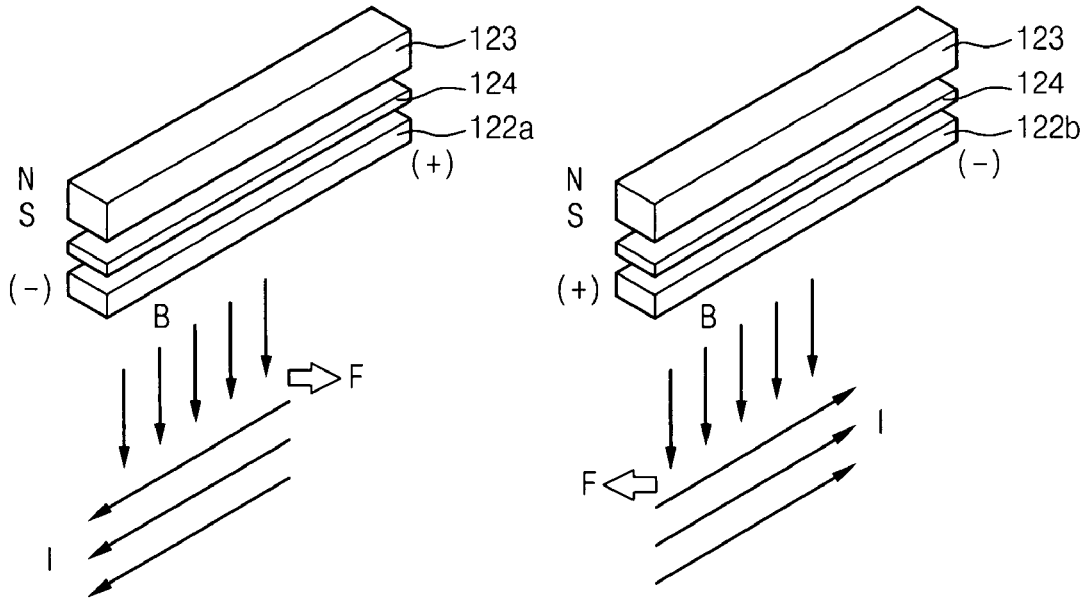
FIG. 5 illustrates the direction of electromagnetic force near a slit shown in FIG. 3.

Referring to FIG. 5, an electric wire 122*a*, which is positioned on one side of a slit 125 of the mask 120, has (+) and (−) electrodes defined on right and left ends, respectively. In this case, the current flows from right to left, and the magnetic field is directed from top to bottom, because the N pole is defined on the top. As a result, electromagnetic force F is created and directed from one side of the slit 125 to the other side thereof.

Another electric wire 122*b*, which is positioned on the other side of the slit 125 of the mask 120, has (+) and (−) electrodes defined on left and right ends, respectively. In this case, the current flows from left to right, and the magnetic field is directed from top to bottom, because the N pole is defined on the top. As a result, electromagnetic force F is created and directed from the other side of the slit 125 to one side thereof.

The electromagnetic force F acts in the same manner even when the direction of magnetic field and electrodes is reversed. In other words, a pair of electromagnetic forces F are still created so as to face each other even when N and S poles are defined on the bottom and top, respectively, and when the electric wire 122*a* has (+) and (−) electrodes defined on left and right ends, respectively, and the electric wire 122*b* has (+) and (−) electrodes defined on right and left ends, respectively.

As such, the pair of electromagnetic forces F, which are created from both sides of the slit 125, are directed towards the center of the slit 125 so that the electrically conductive ink 130, which is sprayed from the nozzle 111, converges and falls towards the center of the slit 125.

The inkjet printer, which is constructed as above, can control the direction of movement of electrically conductive ink, which is sprayed from the inkjet head, by using the mask, which establishes an electromagnetic field. This improves the accuracy when spraying ink.

In the drawings, reference numeral 210 refers to an upper substrate and 211 is a black matrix.

As mentioned above, the inkjet printer according to the present invention is advantageous in that a mask is positioned in the falling path of ink, which is sprayed from the inkjet head, and establishes an electromagnetic field. This improves the accuracy when spraying ink.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An inkjet printer comprising:

an inkjet head containing electrically conductive ink and having a nozzle for spraying the ink and a mask positioned on a side of the inkjet head, the mask having a number of slits formed so that the electrically conductive ink passes through the slits and an electromagnetic field is established wherein the mask has a number of electric wires positioned on a highly-elastic thin metallic layer so that opposite polarities alternate with each other while being adjacent to each other and magnets laminated on the electric wires with an insulation layer interposed between each layer.

2. The inkjet printer as claimed in claim 1, wherein the magnets establish a magnetic field in a predetermined direction and a current flows through the electric wires in a predetermined direction so that electromagnetic force is created by the magnetic field and the current towards a center of the slits.

* * * * *